US007322807B2

(12) United States Patent
Clendenin et al.

(10) Patent No.: US 7,322,807 B2
(45) Date of Patent: Jan. 29, 2008

(54) SCROLL MACHINE WITH AXIALLY COMPLIANT MOUNTING

(75) Inventors: Harry Clendenin, Sidney, OH (US); Jonathan V Martinez, Spokane Valley, WA (US); Keith Reinhart, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/451,645

(22) Filed: Jun. 13, 2006

(65) Prior Publication Data

US 2006/0233655 A1 Oct. 19, 2006

Related U.S. Application Data

(63) Continuation of application No. 10/800,428, filed on Mar. 15, 2004, now Pat. No. 7,070,401.

(51) Int. Cl.
*F04C 18/00* (2006.01)

(52) U.S. Cl. ..... 418/55.5; 418/55.1; 418/55.4; 418/57

(58) Field of Classification Search ..... 418/55.1–55.6, 418/57

See application file for complete search history.

(56) References Cited

U.S. PATENT DOCUMENTS

| | | | |
|---|---|---|---|
| 2,841,089 | A | 7/1958 | Jones |
| 3,600,114 | A | 8/1971 | Dvorak et al. |
| 3,874,827 | A | 4/1975 | Young |
| 3,884,599 | A | 5/1975 | Young et al. |
| 4,065,279 | A | 12/1977 | McCullough |
| 4,160,629 | A | 7/1979 | Hidden et al. |
| 4,300,875 | A | 11/1981 | Fischer et al. |
| 4,304,535 | A | 12/1981 | Terauchi |
| 4,314,796 | A | 2/1982 | Terauchi |
| 4,332,535 | A | 6/1982 | Terauchi et al. |
| 4,395,205 | A | 7/1983 | McCullough |
| 4,431,388 | A | 2/1984 | Eber et al. |
| 4,496,296 | A | 1/1985 | Arai et al. |
| 4,609,334 | A | 9/1986 | Muir et al. |
| 4,655,697 | A | 4/1987 | Nakamura et al. |
| 4,743,181 | A | 5/1988 | Murayama et al. |
| 4,767,293 | A | 8/1988 | Caillat et al. |
| 4,838,769 | A | 6/1989 | Gannaway |
| 4,840,545 | A | 6/1989 | Moilanen |
| 4,911,620 | A | 3/1990 | Richardson, Jr. et al. |

(Continued)

FOREIGN PATENT DOCUMENTS

| | | |
|---|---|---|
| EP | 0012616 | 2/1984 |

(Continued)

*Primary Examiner*—Theresa Trieu
(74) *Attorney, Agent, or Firm*—Harness, Dickey & Pierce, P.L.C.

(57) ABSTRACT

A scroll compressor includes a compression mechanism contained within a shell. A non-orbiting scroll is supported for axial displacement relative the shell, and includes an end plate having a wrap extending therefrom and a flange having a bore extending therethrough. A guide member is axially fixed relative the shell and extends through the bore in the flange. A first portion of the guide member is disposed within and generally abuts a first circumferential portion of the bore. A second portion of the guide member is disposed within and generally spaced apart from a second circumferential portion of the bore.

27 Claims, 12 Drawing Sheets

U.S. PATENT DOCUMENTS

| | | | | |
|---|---|---|---|---|
| 4,932,845 | A | 6/1990 | Kikuchi et al. | |
| 5,088,906 | A | 2/1992 | Richardson, Jr. | |
| 5,102,316 | A | 4/1992 | Caillat et al. | |
| 5,407,335 | A | 4/1995 | Caillat et al. | |
| 5,505,595 | A | 4/1996 | Fukui | |
| 6,086,335 | A | 7/2000 | Bass et al. | |
| 6,261,072 | B1 | 7/2001 | Abe et al. | |
| 6,345,966 | B1 * | 2/2002 | Hahn et al. | 418/55.1 |
| 6,554,592 | B1 | 4/2003 | Sun et al. | |

FOREIGN PATENT DOCUMENTS

| | | |
|---|---|---|
| JP | 55-72685 | 5/1980 |
| JP | 58-47101 | 3/1983 |
| JP | 58-172401 | 10/1983 |
| JP | 58-192901 | 11/1983 |
| JP | 59-142488 | 9/1984 |
| JP | 59-117895 | 8/1986 |
| JP | 61-197785 | 9/1986 |
| JP | 61-215479 | 9/1986 |
| JP | 62-126288 | 6/1987 |
| JP | 62-150001 | 7/1987 |
| JP | 62-199986 | 9/1987 |
| JP | 62225793 | 10/1987 |
| JP | 1267382 | 10/1989 |
| JP | 3-185287 | 8/1991 |
| JP | 3237283 | 10/1991 |
| JP | 4-5490 | 1/1992 |
| JP | 09032752 | 2/1997 |

* cited by examiner

SCROLL MACHINE WITH AXIALLY COMPLIANT MOUNTING

CROSS-REFERENCE TO RELATED APPLICATIONS

This application is a continuation of U.S. patent application Ser. No. 10/800,428 filed on Mar. 15, 2004 now U.S. Pat. No. 7,070,401. The disclosure of the above application is incorporated herein by reference.

FIELD

The present invention relates to mounting arrangements for the scroll member of a scroll machine. More particularly, the present invention relates to mounting one of the scroll members for axial compliance.

BACKGROUND AND SUMMARY

A class of machines exists in the art generally known as "scroll" machines for the displacement of various types of fluids. Such machines may be configured as an expander, a displacement engine, a pump, a compressor, etc., and the features of the present teachings are applicable to any one of these machines. For purposes of illustration, however, the disclosed embodiments are in the form of a hermetic refrigerant compressor.

Generally speaking, a scroll machine comprises two spiral scroll wraps of similar configuration, each mounted on a separate end plate to define a scroll member. The two scroll members are interfitted together with one of the scroll wraps being rotationally displaced 180° from the other. The machine operates by orbiting one scroll member (the "orbiting scroll") with respect to the other scroll member (the "fixed scroll" or "non-orbiting scroll") to make moving line contacts between the flanks of the respective wraps, defining moving isolated crescent-shaped pockets of fluid. The spirals are commonly formed as involutes of a circle, and ideally there is no relative rotation between the scroll members during operation; i.e., the motion is purely curvilinear translation (i.e., no rotation of any line in the body). The fluid pockets carry the fluid to be handled from a first zone in the scroll machine where a fluid inlet is provided, to a second zone in the machine where a fluid outlet is provided. The volume of a sealed pocket changes as it moves from the first zone to the second zone. At any one instant in time there will be at least one pair of sealed pockets; and where there are several pairs of sealed pockets at one time, each pair will have different volumes. In a compressor, the second zone is at a higher pressure than the first zone and is physically located centrally in the machine, the first zone being located at the outer periphery of the machine.

Two types of contacts define the fluid pockets formed between the scroll members, axially extending tangential line contacts between the spiral faces or flanks of the wraps caused by radial forces ("flank sealing"), and area contacts caused by axial forces between the plane edge surfaces (the "tips") of each wrap and the opposite end plate ("tip sealing"). For high efficiency, good sealing must be achieved for both types of contacts; however, the present teachings are primarily concerned with tip sealing.

The concept of a scroll-type machine has thus been known for some time and has been recognized as having distinct advantages. For example, scroll machines have high isentropic and volumetric efficiency, and, hence, are relatively small and lightweight for a given capacity. They are quieter and more vibration free than many machines because they do not use large reciprocating parts (e.g., pistons, connecting rods, etc.); and because all fluid flow is in one direction with simultaneous compression in plural opposed pockets, there are less pressure-created vibrations. Such machines also tend to have high reliability and durability because of the relatively few moving parts utilized, the relatively low velocity of movement between the scrolls. Scroll machines which have compliance to allow tip leakage have an inherent forgiveness to fluid contamination.

One of the difficult areas of design in a scroll-type machine concerns the technique used to achieve tip sealing under all operating conditions, and also speeds in a variable speed machine. Conventionally, this has been accomplished by (1) using extremely accurate and very expensive machining techniques, (2) providing the wrap tips with spiral tip seals, which, unfortunately, are hard to assemble and often unreliable, or (3) applying an axially restoring force by axial biasing the orbiting scroll or the non-orbiting scroll towards the opposing scroll using compressed working fluid. The latter technique has some advantages but also presents problems, namely, in addition to providing a restoring force to balance the axial separating force, it is also necessary to balance the tipping moment on the scroll member due to pressure-generated radial forces which are dependent on suction and discharge pressures, as well as the inertial loads resulting from the orbital motion which is speed dependent. Thus, the axial balancing force must be relatively high, and will be optimal at only certain pressure and speed combinations.

The utilization of an axial restoring force requires one of the two scroll members to be mounted for axial movement with respect to the other scroll member. This can be accomplished by securing the non-orbiting scroll member to a main bearing housing by means of a plurality of bolts and a plurality of sleeve guides as disclosed in Assignee's U.S. Pat. No. 5,407,335, the disclosure of which is hereby incorporated herein by reference. In the mounting system which utilizes bolts and sleeve guides, arms formed on the non-orbiting scroll member are made to react against the sleeve guides. The sleeve guides hold the scroll member in proper alignment. The non-orbiting scroll member experiences gas forces in the radial and tangential direction whose centroid of application is at or near the mid-height of the scroll vane or wrap. The non-orbiting scroll member also experiences tip and base friction which can be randomly more on one than the other, but can be assumed as being equal and, therefore, having a centroid at or near the mid-height of the scroll wrap or vane. The non-orbiting scroll member additionally experiences flank contact forces from the centripetal acceleration of the orbiting scroll member which acts closer to the vane tip than at the base of the vane. All of these forces combine to yield a centroid of action which is located at a point just off the mid-height of the scroll wrap or vane toward the vane tip.

When the arms of the non-orbiting scroll member are located at the same elevation as the centroid of action of the forces experienced, the sleeve guides reaction could be equal and coplanar. When the arms are located near the tip of the vane of the non-orbiting scroll member, the reaction is not located at the centroid of action of the forces, it is offset from the centroid in a first direction. This offset produces a moment which reacts between the arm of the non-orbiting scroll member and the sleeve guide. Similarly, when the arms are located near the end plate of the non-orbiting scroll member, the reaction is again not located at the centroid of action of the forces, it is offset from the centroid in a second direction, opposite to the first direction. This offset also produces a moment which reacts between the arm of the non-orbiting scroll member and the sleeve guide.

Countering this moment is a moment produced by the hold-down force on the top of the non-orbiting scroll member, the axial gas separating force and the tip force pushing up on the vanes. The tip force can move to the radially outward most tip establishing a moment arm back to the centerline axis of the scroll wrap profile. The desire for high efficiency leads to a design with minimal tip load and, thus, the countering moment is of limited magnitude with no motivation to increase it.

In some scroll member designs, the sleeve guide reaction is so close to the non-orbiting scroll tip or so close to the non-orbiting end plate that it is far out of the plane of the centroid of action of the forces; and this causes the overturning moment to exceed the restoring moment. This causes the non-orbiting scroll member to rock up on one side, separating the tips from the bases of the scroll members on that side. This separation causes leakage which reduces the capacity of the compressor and, to a lesser extent, increases power.

The load which is applied to this sleeve guide tends to lean the sleeve guide away from the load. As this occurs, the load does not distribute evenly over the axial height of the non-orbiting scroll member arm, but it concentrates in the area near or away from the tip of the non-orbiting scroll member vane, near the bottom or top of the hole in the arm. This tendency increases the moment arm of the overturning moment.

A stepped geometry for the sleeve guide prevents contact between the arm of the non-orbiting scroll member and the sleeve guide at specific locations by reducing the diameter of the sleeve guide at that specific location. This concept allows the centroid of the reaction forces on the sleeve guide against the arms of the non-orbiting scroll member to be relocated from its normal axial position to a more preferred axial position.

In a first embodiment, the centroid of reaction of the sleeve guide focuses the centroid toward the top of the hole in the arm of the non-orbiting scroll member. This reduces the moment arm of the overturning moment for these scroll designs. The sleeve guide has a reduced diameter at a specified distance below the top of the sleeve, this distance being less than the axial height of the arm of the non-orbiting scroll member.

In another embodiment, the reduced diameter is located only at the mid-section of the sleeve guide. The reduction in diameter does not extend to either end of the sleeve guide. This enables the sleeve guide to be symmetrical so that it can be assembled with either end up to produce the same effect.

In another embodiment, the hole in the arm of the non-orbiting scroll member is machined as a stepped hole with the larger portion of the stepped hole being located nearest the vane tip.

In another embodiment, the centroid of reaction of the sleeve guide focuses the centroid toward the bottom of the hole in the arm of the non-orbiting scroll member. This reduces the moment arm of the overturning moment for these scroll designs. The sleeve guide has a reduced diameter at a specified distance above the top of the sleeve, this distance being less than the axial height of the arm of the non-orbiting scroll member.

In another embodiment, the reduced diameter is located only at the opposing ends of the sleeve guide. The reduction in diameter does not extend to the middle of the sleeve guide. This enables the sleeve guide to be symmetrical so that it can be assembled with either end up to produce the same effect.

In another embodiment, the hole in the arm of the non-orbiting scroll member is machined as a stepped hole with the larger portion of the stepped hole being located away from the vane tip.

In another embodiment, a scroll compressor includes a compression mechanism contained within a shell and including a non-orbiting scroll supported for axial displacement relative the shell and including an end plate having a wrap extending therefrom and a flange having a bore extending therethrough. A guide member may be axially fixed relative the shell and extend through the bore in the flange so that a first portion of the guide member is disposed within and generally abuts a first circumferential portion of the bore and a second portion of the guide member is disposed within and generally spaced apart from a second circumferential portion of the bore.

In another embodiment, a scroll compressor includes a compression mechanism contained within a shell and including a non-orbiting scroll supported for axial displacement relative the shell. The non-orbiting scroll includes an end plate having a wrap extending therefrom and a flange having a bore extending therethrough. A guide member is axially fixed relative the shell and extending through the bore in the flange. A first portion of the guide member is disposed within a circumferential portion of the bore and includes a first maximum width portion having a first width generally abutting the circumferential portion of the bore. A second portion of the guide member is disposed within the circumferential portion of the bore and includes a second maximum width portion having a second width generally less than the first width.

In another embodiment, a scroll compressor includes a compression mechanism contained within the shell and including a non-orbiting scroll supported for axial displacement relative the shell. The non-orbiting scroll includes an end plate having a wrap extending therefrom and a flange having a bore extending therethrough. A guide member is axially fixed relative the shell and extends through the bore in the flange. A first portion of the guide member is disposed within the bore, which includes first and second circumferential portions spaced axially apart from one another. The first circumferential portion generally abuts the guide member first portion at a first minimum width portion having a first width. The second circumferential portion includes a second minimum width portion having a second width generally greater than the first width, wherein the second circumferential portion is spaced radially apart from said guide member first portion to define a recess therebetween.

Further areas of applicability of the present teachings will become apparent from the detailed description provided hereinafter. It should be understood that the detailed description and specific examples are intended for purposes of illustration only and are not intended to limit the scope of the claims.

BRIEF DESCRIPTION OF THE DRAWINGS

The present teachings will become more fully understood from the detailed description and the accompanying drawings, wherein.

DETAILED DESCRIPTION

The following description of the preferred embodiment(s) is merely exemplary in nature and is in no way intended to limit the teachings, its application, or uses.

Figure 1:
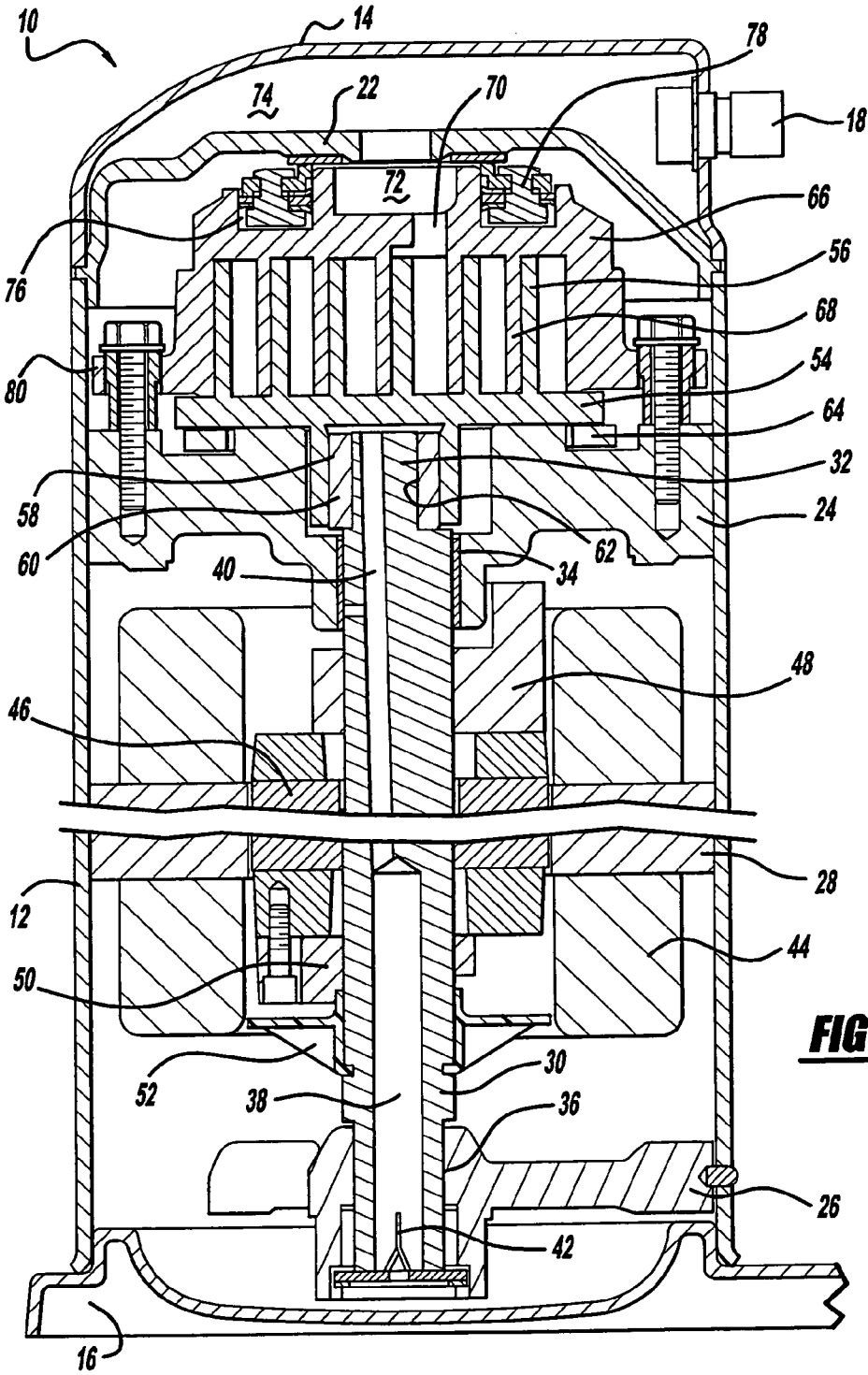
FIG. 1 is a vertical cross-sectional view of a scroll compressor incorporating a non-orbiting scroll mounting arrangement.

There is illustrated in FIG. 1 a scroll compressor which incorporates a non-orbiting scroll mounting arrangement in accordance with the present teachings and which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a stationary main bearing housing or body 24 which is suitably secured to shell 12, and a lower bearing housing 26 also having a plurality of radially outwardly extending legs, each of which is also suitably secured to shell 12. A motor stator 28, which is generally square in cross-section but with the corners rounded off, is pressfitted into shell 12. The flats between the rounded corners on the stator provide passageways between the stator and shell, which facilitate the flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of the crankshaft. Disposed within bore 38 is a stirrer 42. The lower portion of the interior shell 12 is filled with lubricating oil, and bore 38 acts as a pump to pump lubricating fluid up the crankshaft 30 and into passageway 40, and ultimately to all of the various portions of the compressor which require lubrication.

Crankshaft 30 is rotatively driven by an electric motor including stator 28, windings 44 passing therethrough and a rotor 46 pressfitted on the crankshaft 30 and having upper and lower counterweights 48 and 50, respectively. A counterweight shield 52 may be provided to reduce the work loss caused by counterweight 50 spinning in the oil in the sump. Counterweight shield 52 is more fully disclosed in Assignee's U.S. Pat. No. 5,064,356 entitled "Counterweight Shield For Scroll Compressor," the disclosure of which is hereby incorporated herein by reference.

The upper surface of main bearing housing 24 is provided with a flat thrust bearing surface on which is disposed an orbiting scroll member 54 having the usual spiral vane or wrap 56 on the upper surface thereof. Projecting downwardly from the lower surface of orbiting scroll member 54 is a cylindrical hub having a journal bearing 58 therein and in which is rotatively disposed a drive bushing 60 having an inner bore 62 in which crank pin 32 is drivingly disposed. Crank pin 32 has a flat on one surface which drivingly engages a flat surface (not shown) formed in a portion of bore 62 to provide a radially compliant driving arrangement, such as shown in aforementioned Assignee's U.S. Pat. No. 4,877,382, the disclosure of which is hereby incorporated herein by reference. An Oldham coupling 64 is also provided positioned between and keyed to orbiting scroll 54 and bearing housing 24 to prevent rotational movement of orbiting scroll member 54. Oldham coupling 64 is preferably of the type disclosed in the above-referenced U.S. Pat. No. 4,877,382; however, the coupling disclosed in Assignee's U.S. Pat. No. 5,320,506 entitled "Oldham Coupling For Scroll Compressor", the disclosure of which is hereby incorporated herein by reference, may be used in place thereof.

Figure 2:
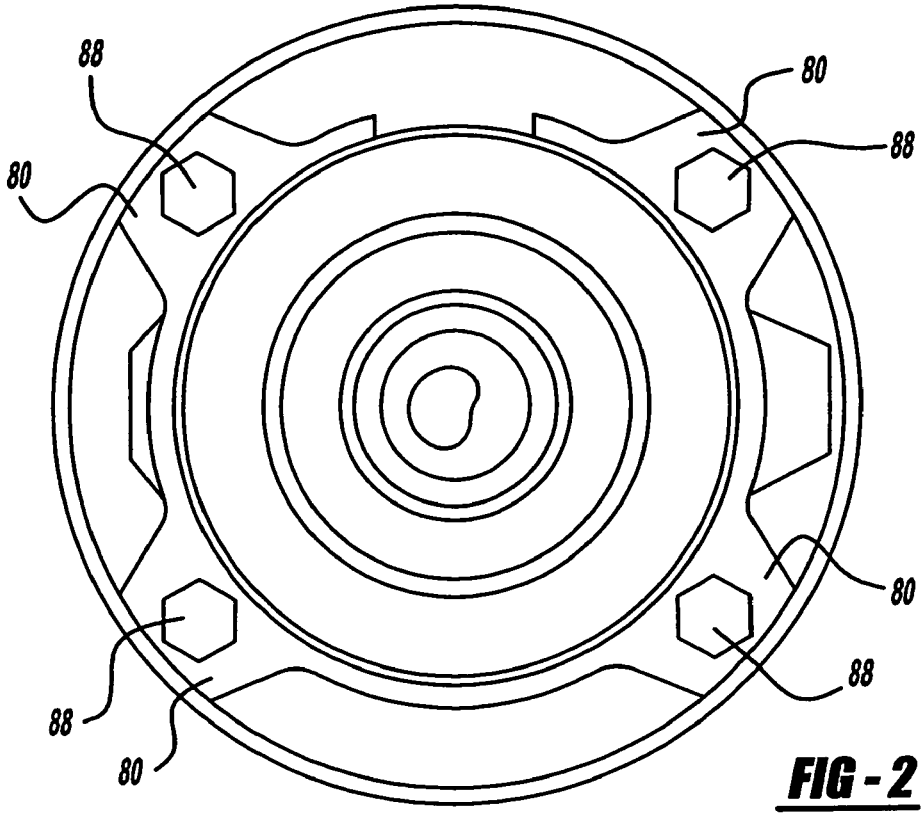
FIG. 2 is a section view of the compressor of FIG. 1, the section being taken along line 2-2 thereof.

A non-orbiting scroll member 66 is also provided having a wrap 68 positioned in meshing engagement with wrap 56 of orbiting scroll member 54. Non-orbiting scroll member 66 has a centrally disposed discharge passage 70 communicating with an upwardly open recess 72 which is in fluid communication with a discharge muffler chamber 74 defined by cap 14 and partition 22. An annular recess 76 is also formed in non-orbiting scroll member 66 within which is disposed a seal assembly 78. Recesses 72 and 76 and seal assembly 78 cooperate to define axial pressure biasing chambers which receive pressurized fluid being compressed by wraps 56 and 68 so as to exert an axial biasing force on non-orbiting scroll member 66 to thereby urge the tips of respective wraps 56, 68 into sealing engagement with the opposed end plate surfaces. Seal assembly 78 is preferably of the type described in greater detail in Assignee's U.S. Pat. No. 5,156,539, entitled "Scroll Machine With Floating Seal," the disclosure of which is hereby incorporated herein by reference. Non-orbiting scroll member 66 is designed to be mounted to bearing housing 24 and to this end has a plurality of radially outwardly projecting flange portions 80 circumferentially spaced around the periphery thereof as shown in FIG. 2.

Figure 3:
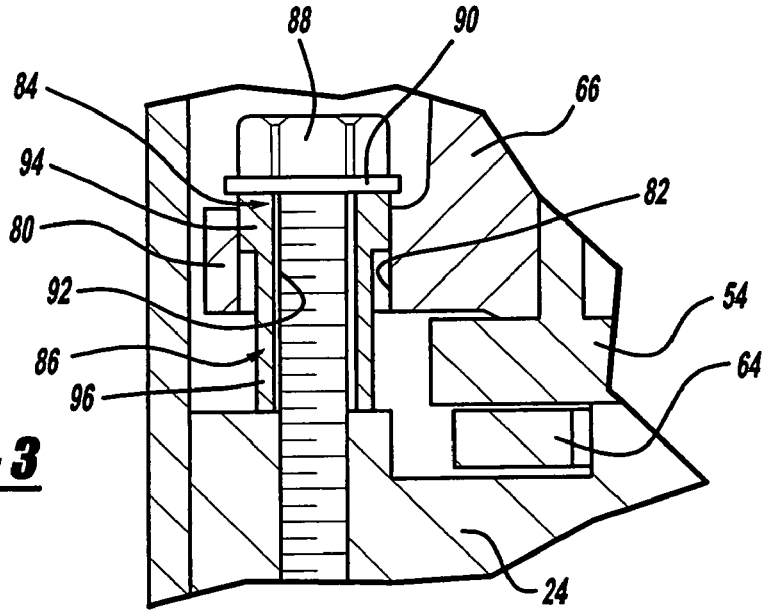
FIG. 3 is an enlarged fragmentary section view of the mounting arrangement shown in FIG. 1.

As best seen with reference to FIG. 3, flange portion 80 of non-orbiting scroll member 66 has an opening 82 provided therein within which is fitted an elongated cylindrical bushing 84, the lower end 86 of which is seated on bearing housing 24. Bushing 84 may form a guide member for non-orbiting scroll member 66, as discussed below. A bolt 88 having a head washer 90 extends through an axially extending bore 92 provided in bushing 84 and into a threaded opening provided in bearing housing 24. As shown, bore 92 of bushing 84 is of a diameter greater than the diameter of bolt 88 so as to accommodate some relative movement therebetween to enable final precise positioning of non-orbiting scroll member 66. Once non-orbiting scroll member 66 and, hence, bushing 84 have been precisely positioned, bolt 88 may be suitably torqued thereby securely and fixedly clamping bushing 84 between bearing housing 24 and washer 90. Washer 90 serves to ensure uniform circumferential loading on bushing 84 as well as to provide a bearing surface for the head of bolt 88 thereby avoiding any potential shifting of bushing 84 during the final torquing of bolt 88. It should be noted that as shown in FIG. 3, the axial length of bushing 84 will be sufficient to allow non-orbiting scroll member 66 to slidably move axially along bushing 84 in a direction away from orbiting scroll member 54, thereby affording an axially compliant mounting arrangement with washer 90 and the head of bolt 88 acting as a positive stop limiting such movement. Substantially identical bushings, bolts and washers are provided for each of the other flange portions 80. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of the non-orbiting scroll is accommodated by the clearances provided between bolts 88 and the associated bushings 84, the threaded openings in bearing housing 24 need not be as precisely located as would otherwise be required, thus reducing the manufacturing costs associated therewith.

Bushings 84 include a large diameter portion 94 which provides a first clearance between bushing 84 and flange portion 80 and a small diameter portion 96 which provides a second clearance (or annular recess) between bushing 84 and flange portion 80. The second clearance being greater than the first clearance. Large and small diameter portions 94, 96 may form first and second portions of bushing (or guide member) 84. Large diameter portion 94 may include a greater width and/or perimeter than small diameter portion 96. The relative diameters of large diameter portion 94 and the diameter of opening 82 will be such as to allow sliding movement therebetween yet effectively resist radial and/or circumferential movement of non-orbiting scroll member 66. Large diameter portion 94 is located at the upper side or top of bushing 84 in order to move the centroid of reaction for bushing 84 away from the tip of wrap 68 of non-orbiting scroll member 66. More specifically, a first plane may be defined at an end plate surface of non-orbiting scroll member 66 and a second plane may be defined at a tip of wrap 68 of non-orbiting scroll member 66. Large diameter portion 94 may be located proximate to the second plane.

Figure 4:
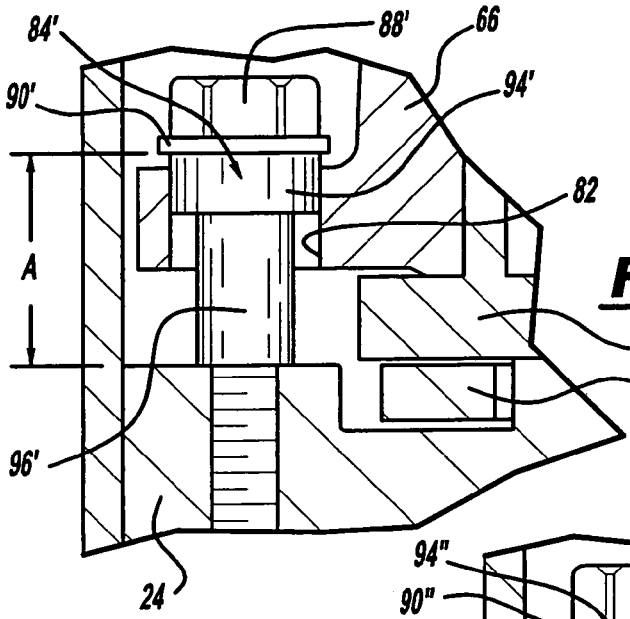
FIGS. 4-11 are views similar to FIG. 3, but showing mounting arrangements in accordance with other embodiments.

Alternatively, as shown in FIG. 4, the bolts 88 and bushings 84 may be replaced by a shoulder bolt 88' having a shoulder portion 84'. In the example of FIG. 4, shoulder bolt 88' may form a guide member for non-orbiting scroll member 66. Shoulder portion 84' of shoulder bolt 88' includes a large diameter portion 94' and a small diameter portion 96'. Large and small diameter portions 94', 96' may form first and second portions of shoulder bolt (or guide member) 88'. Large diameter portion 94' may include a greater width and/or perimeter than small diameter portion 96'. Large diameter portion 94' is located at the upper side or top of shoulder portion 84' in order to move the centroid of reaction for shoulder portion 84' of shoulder bolt 88' away from the tip of wrap 68 of non-orbiting scroll member 66. Large diameter portion 94' may be located proximate to the second plane at the tip of wrap 68 discussed above. Large diameter portion 94' of shoulder bolt 88' is slidably fit within openings 82 provided in flange portions 80 of non-orbiting scroll member 66. In this embodiment, the axial length "A" of shoulder portion 84' of shoulder bolt 88' will be selected such that a slight clearance will be provided between an integral washer 90' of the head portion of bolt 88' and the opposed surface of flange portion 80 when non-orbiting scroll member 66 is fully seated against orbiting scroll member 54 to thereby permit a slight axial separation movement in a like manner to that described above with reference to FIG. 3. Also, as noted above, integral washer 90' of bolt 88' will act as a positive stop to limit this axial separating movement of non-orbiting scroll member 66. The relative diameters of large diameter portion 94' and bore 82 will be such as to allow sliding movement therebetween, yet effectively resist radial and/or circumferential movement of non-orbiting scroll member 66. While this embodiment eliminates concern over potential shifting of bushing 84 relative to bolt 88 which could occur in the embodiment of FIG. 3, it is somewhat more costly in that the threaded holes in bearing housing 24 must be precisely located.

Figure 5:
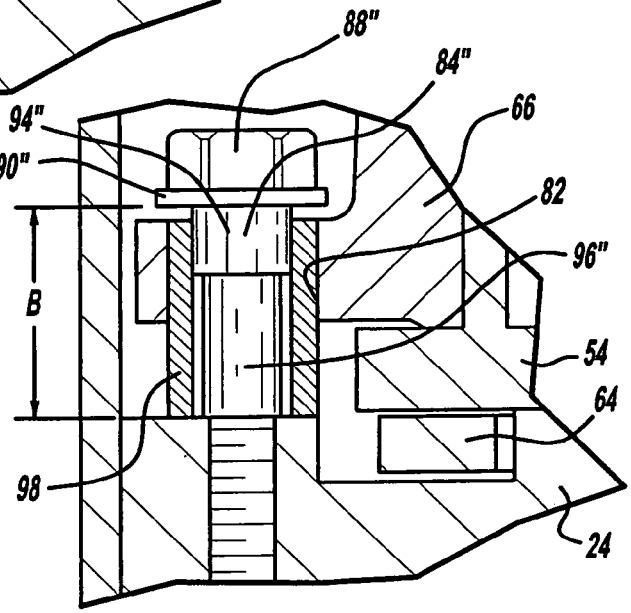

FIG. 5 illustrates another embodiment of the present invention. In FIG. 5, a bushing 98 is pressfitted within each of the openings 82 provided in respective flange portions 80. A stepped shoulder bolt 88" is provided extending through bushing 98 and, as described above for FIG. 4, includes a shoulder portion 84" having an axial length "B" selected with respect to the length of bushing 98 to afford the axial movement of non-orbiting scroll member 66. In the example of FIG. 5, shoulder bolt 88" may form a guide member for non-orbiting scroll member 66. Shoulder portion 84" of shoulder bolt 88" includes a large diameter portion 94" and a small diameter portion 96". Large and small diameter portions 94", 96" may form first and second portions of shoulder bolt (or guide member) 88". Large diameter portion 94" may include a greater width and/or perimeter than small diameter portion 96". Large diameter portion 94" is located at the upper side or top of shoulder portion 84" in order to move the centroid of reaction for shoulder portion 84" of shoulder bolt 88" away from the tip of wrap 68 of non-orbiting scroll member 66. Large diameter portion 94" may be located proximate to the second plane at the tip of wrap 68 discussed above. In this embodiment, because bushing 98 is pressfitted within opening 82, it will slidably move along large diameter portion 94" of shoulder portion 84" of bolt 88" along with non-orbiting scroll member 66 to afford the desired axially compliant mounting arrangement. This embodiment allows for somewhat less precise locating of the threaded bores in bearing housing 24 as compared to the embodiment of FIG. 4 in that bushing 98 may be bored and/or reamed to provide the final precise positioning of non-orbiting scroll member 66. Further, because the axial movement occurs between bushing 98 and shoulder bolt 88", concern as to possible wearing of openings 82 provided in non-orbiting scroll member 66 is eliminated because any wear occurs between bushing 98 and shoulder bolt 88". As shown, bushing 98 has an axial length such that it is seated on bearing housing 24 when non-orbiting scroll member 66 is fully seated against orbiting scroll member 54; however, if desired, a shorter bushing 98 could be utilized in place thereof. Again, as in the above-described embodiments, an integral washer 90" of shoulder bolt 88" will cooperate either with the end of bushing 98 or flange 80 as desired to provide a positive stop limiting axial separating movement of non-orbiting scroll member 66.

Figure 6:
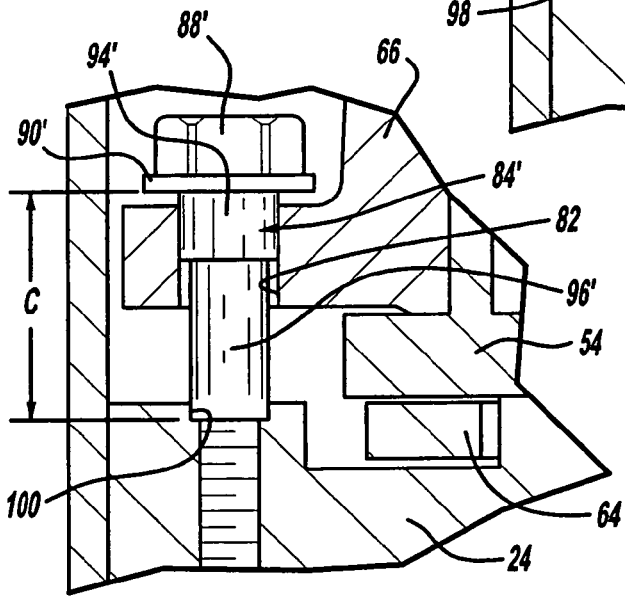

In the embodiment of FIG. 6, a counterbore 100 is provided in bearing housing 24. Counterbore 100 serves to receive small diameter portion 96' of shoulder portion 84' of bolt 88' illustrated in FIG. 4. In the example of FIG. 6, shoulder bolt 88' may form a guide member for non-orbiting scroll member 66. Again, the axial length "C" of shoulder portion 84' will be selected so as to allow for the desired limited axial movement of non-orbiting scroll member 66 and integral washer 90' of bolt 88' will provide a positive stop therefor. Because counterbore 100 can be reamed to establish the precise relative location of non-orbiting scroll member 66, the tolerance for locating the threaded bore in bearing housing 24 may be increased somewhat. Further, this embodiment eliminates the need to provide and assemble separately fabricated bushings. Also, similarly to that described above, the relative diameters of large diameter portion 94' of shoulder portion 88' with respect to bore 82 in non-orbiting scroll member 66 will be such to accommodate axial sliding movement yet resist radial and circumferential movement. Similar to FIG. 4, large diameter portion 94' is located at the upper side or top of shoulder portion 88' in order to move the centroid of reaction for shoulder portion 84' of shoulder bolt 88' away from the tip of wrap 68 of non-orbiting scroll member 66. Thus, the embodiment of FIG. 6 is similar to the embodiment of FIG. 4 and the description of FIG. 4 applies to FIG. 6.

Figure 7:
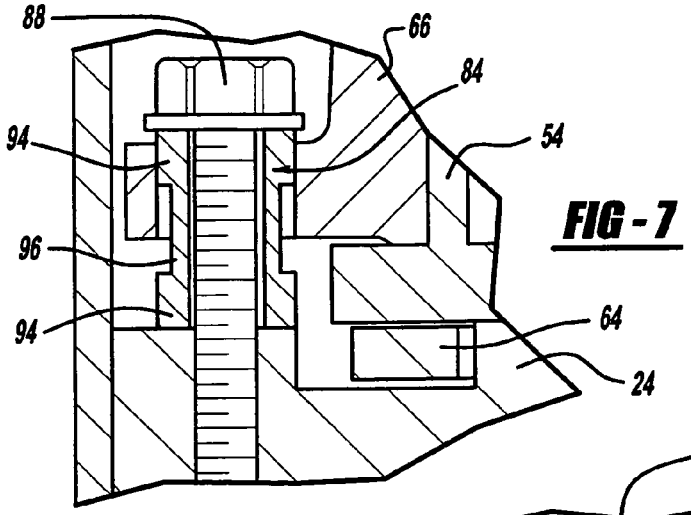

Referring now to FIG. 7, another embodiment of the present invention is illustrated. The embodiment illustrated in FIG. 7 is the same as that described above for FIG. 3 but in FIG. 7, bushing 84 includes two large diameter portions 94 and small diameter portion 96. In the example of FIG. 7, bushing 84 may form a guide member for non-orbiting scroll member 66. By incorporating two large diameter portions 94 at opposite sides of bushing 84, bushing 84 becomes symmetrical, eliminating the need to orient bushing 84 during the assembly process. The description of FIG. 3 above applies to FIG. 7, also with the only difference being the incorporation of the second large diameter portion 94.

Figure 8:
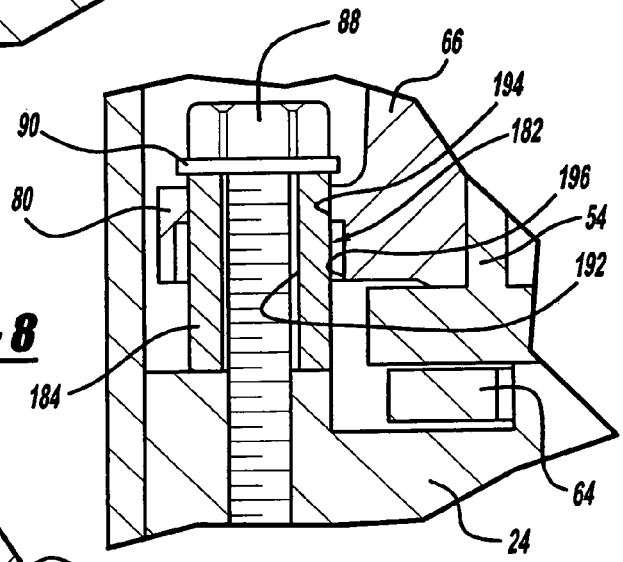

Referring now to FIG. 8, another embodiment of the present invention is illustrated. In the embodiment shown in FIG. 8, flange portion 80 of non-orbiting scroll member 66 has a stepped opening 182 provided therein within which is fitted an elongated cylindrical bushing 184, the lower end of which is seated on bearing housing 24. A bolt 88 having a head with a washer 90 extends through an axially extending bore 192 provided in bushing 184 and into the threaded opening provided in bearing housing 24. In the example of FIG. 8, bushing 184 may form a guide member for non-orbiting scroll member 66. As shown, bore 192 of bushing 184 is of a diameter greater than the diameter of bolt 88 so as to accommodate some relative movement therebetween to enable final precise positioning of non-orbiting scroll member 66. Once non-orbiting scroll member 66, and hence bushing 184, have been precisely positioned, bolt 88 may be suitably torqued, thereby securely and fixedly clamping bushing 184 between bearing housing 24 and washer 90. Washer 90 serves to ensure uniform circumferential loading on bushing 184, as well as to provide a bearing surface for the head of bolt 88, thereby avoiding any potential shifting of bushing 184 during the final torquing of bolt 88. It should be noted that, as shown in FIG. 8, the axial length of bushing 184 will be sufficient to allow non-orbiting scroll member 66 to slidably move axially along bushing 184 in a direction away from the orbiting scroll member 54, thereby affording the axially compliant mounting arrangement with washer 90 and the head of bolt 88 acting as a positive stop limiting such movement. Substantially identical bushings, bolts, washers and holes are provided for each of the other flange portions 80. The amount of separating movement can be relatively small (e.g., on the order of 0.005" for a scroll 3" to 4" in diameter and 1" to 2" in wrap height) and, hence, compressor 10 will still operate to compress even though the separating force resulting therefrom may exceed the axial restoring force such as may occur on start-up. Because the final radial and circumferential positioning of non-orbiting scroll member 66 is provided between bolts 88 and the associated bushings 184, the threaded openings in bearing housing 24 need not be as precisely located as would otherwise be required, thus reducing the manufacturing costs associated therewith.

Stepped opening 182 includes a small diameter portion 194 and a large diameter portion 196. Small and large diameter portions 194, 196 may form first and second circumferential portions of stepped opening 182. Small diameter portion 194 may include a minimum width portion having a width less than a width of a minimum width portion of lame diameter portion 196. The width of bushing 184 may be generally equal to the width of the minimum width portion of small diameter portion 194. The relative diameters of small diameter portion 194 and the outside diameter of bushing 184 will be such as to allow sliding movement therebetween, yet effectively resist radial and/or circumferential movement of non-orbiting scroll member 66. Small diameter portion 194 is located at the upper side or top of flange portion 80 in order to move the centroid of reaction for bushing 184 away from the top of wrap 68 of non-orbiting scroll member 66. A clearance between large diameter portion 196 and bushing 184 may generally form a recess therebetween.

Figure 9:
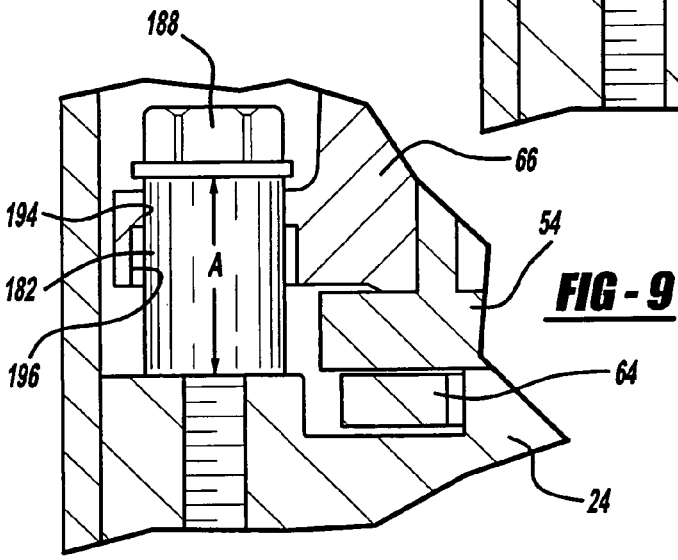

Alternatively, as shown in FIG. 9, bolts 88 and bushings 184 may be replaced by a shoulder bolt 188 slidably fit within stepped openings 182 provided in respective flange portions 80 of non-orbiting scroll member 66. Stepped openings 182 includes small diameter portion 194 and large diameter portion 196. In the example of FIG. 9, shoulder bolt 188 may form a guide member for non-orbiting scroll 66. Small diameter portion 194 is located at the upper side or top of opening 182 in order to move the centroid of reaction for the shoulder portion of shoulder bolt 188 away from the tip of wrap 68 of non-orbiting scroll member 66. In this embodiment, the axial length "A" of the shoulder portion of shoulder bolt 188 will be selected such that a slight clearance will be provided between the head portion of bolt 188 and the opposed surface of flange portion 80 when non-orbiting scroll member 66 is fully axially seated against orbiting scroll member 54 to thereby permit a slight axial separating movement in like manner as described above with reference to FIG. 3. Also, as noted above, the head of bolt 188 will act as a positive stop to limit this axial separating movement of non-orbiting scroll member 66. The relative diameters of small diameter portion 194 of bore 182 and the outer diameter of the shoulder portion of bolt 188 will be such as to allow sliding movement therebetween, yet resist radial and/or circumferential movement of non-orbiting scroll member 66. While this embodiment eliminates concern over potential shifting of the bushing relative to the securing bolt, which could occur in the embodiment of FIG. 8, it is somewhat more costly in that the threaded holes in bearing housing 24 must be precisely located.

Figure 10:
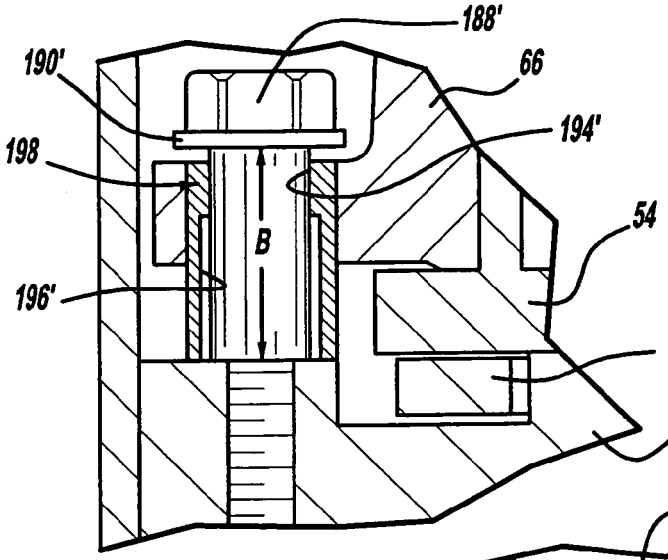

FIG. 10 illustrates another embodiment of the present invention. In FIG. 10, a bushing 198 is pressfitted within each opening 82 provided in respective flange portions 80. A shoulder bolt 188' is provided extending through bushing 198 and, as described above, includes a shoulder portion having an axial length "B" selected with respect to the length of bushing 198 to afford the desired axial movement of non-orbiting scroll member 66. In the example of FIG. 10, shoulder bolt 188' may form a guide member for non-orbiting scroll member 66. Bushing 198 includes a small diameter portion 194' and a large diameter portion 196'. Small diameter portion 194' is located at the upper side or top of opening 82 in order to move the centroid of reaction for the shoulder portion of bolt 188' away from the tip of wrap 68 of non-orbiting scroll member 66. In this embodiment, because bushing 198 is pressfitted within opening 82, it will slidingly move along the shoulder portion of bolt 188' along with non-orbiting scroll member 66 to afford the desired axially compliant mounting arrangement. Additionally, since bushing 198 is coupled to non-orbiting scroll member 66, small and large diameter portions 194', 196' may define the first and second circumferential portions discussed above. This embodiment allows for somewhat less precise locating of the threaded bores in bearing housing 24 as compared to the embodiment of FIG. 9 in that bushing 198 may be bored and/or reamed to provide the final precise positioning of non-orbiting scroll member 66. Further, because the axial movement occurs between bushing 198 and shoulder bolt 188', concerns as to possible wearing of openings 82 provided in non-orbiting scroll member 66 is eliminated because any wear occurs between bushing 198 and shoulder bolt 188'. As shown, bushing 198 has an axial length such that it is seated on bearing housing 24 when non-orbiting scroll member 66 is fully seated against orbiting scroll member 54; however, if desired, a shorter bushing 198 could be utilized in place thereof. Again, as in the above-described embodiments, an integral washer 190' of shoulder bolt 188' will cooperate either with the end of bushing 198 or flange 80 as desired to provide a positive stop limiting axial separating movement of non-orbiting scroll member 66.

Figure 11:
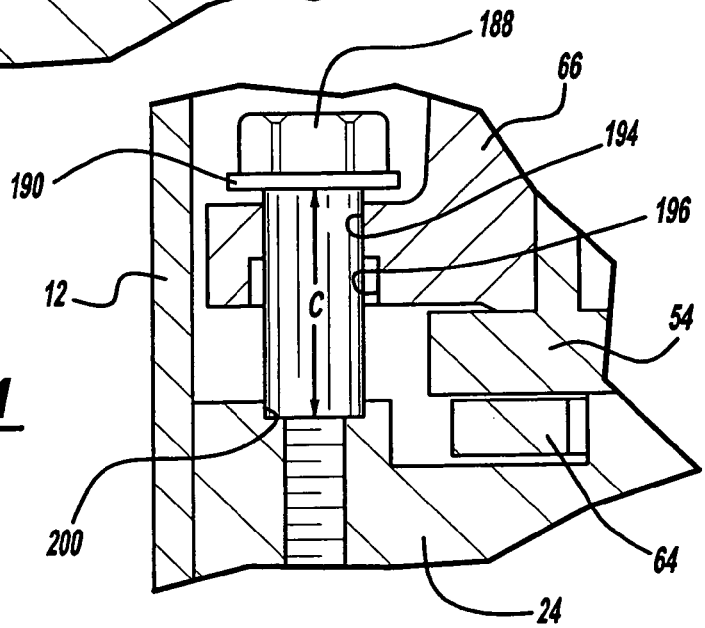

In the embodiment of FIG. 11, a counterbore 200 is provided in bearing housing 24. Counterbore 200 serves to receive the shoulder portion of bolt 188. Again, the axial length "C" of the shoulder portion of bolt 188 will be selected so as to allow for the desired limited axial movement of non-orbiting scroll member 66 and integral washer 190 of bolt 188 will provide a positive stop therefore. Bolt 188 may form a guide member for non-orbiting scroll member 66. Because counterbore 200 can be reamed to establish the precise relative location of non-orbiting scroll member 66, the tolerance for locating the threaded bore of bearing housing 24 may be increased somewhat. Further, this embodiment eliminates the need to provide and assemble separately fabricated bushings. Also similarly to that described above, the relative diameters of the shoulder portion of bolt 188 with respect to small diameter portion 194 of stepped opening 182 in non-orbiting scroll member 66 will be such to accommodate axial sliding movement, yet resist radial and circumferential movement. Similar to FIG. 9, small diameter portion 194 is located at the upper side or top of stepped opening 182 in order to move the centroid of reaction for shoulder bolt 188 away from the tip of wrap 68 of non-orbiting scroll member 66. Thus, the embodiment of FIG. 11 is similar to the embodiment of FIG. 9, and the description of FIG. 9 applies to FIG. 11.

Figure 12:
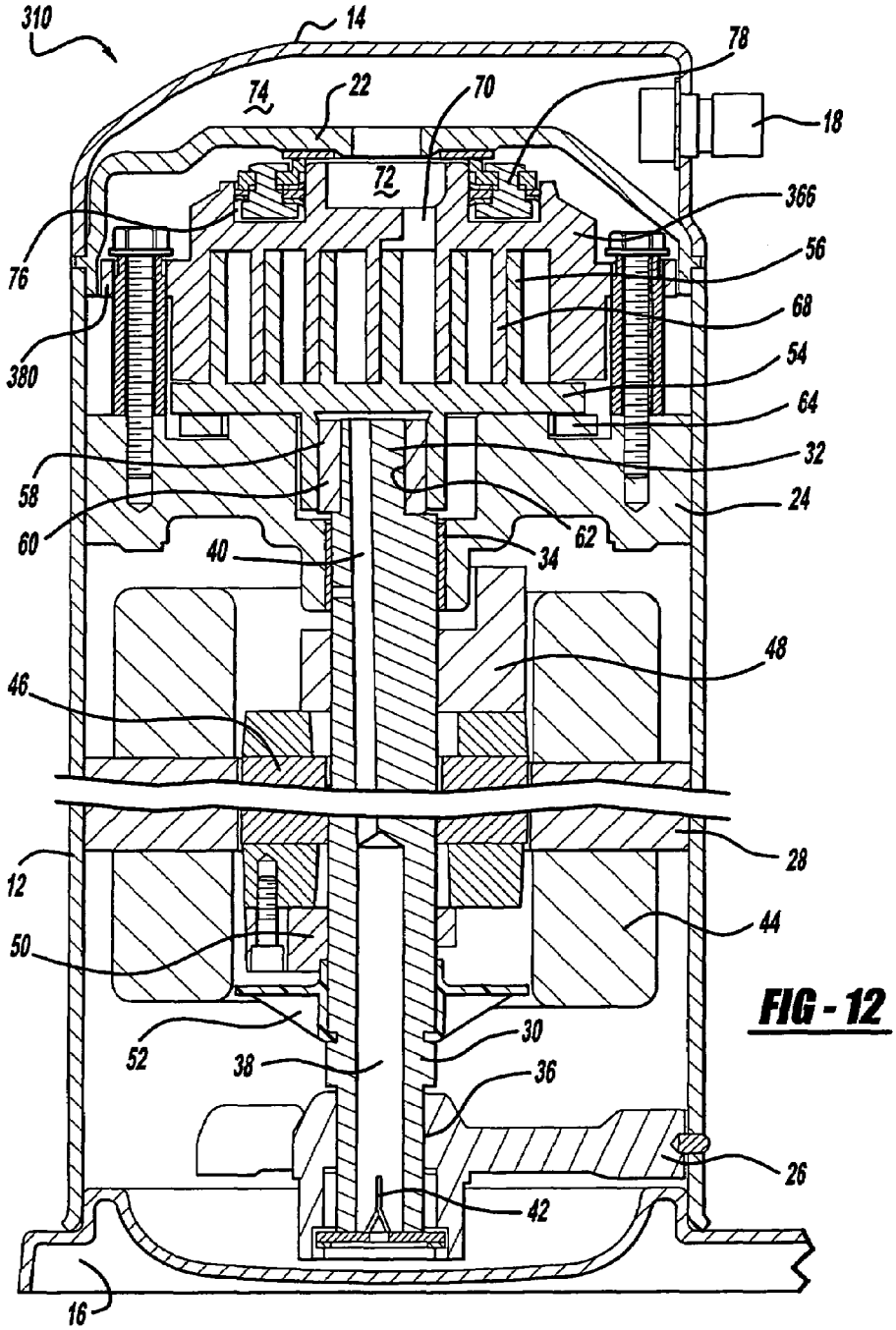
FIG. 12 is a vertical cross-sectional view of a scroll compressor incorporating a non-orbiting scroll mounting arrangement in accordance with another embodiment.
Figure 13:
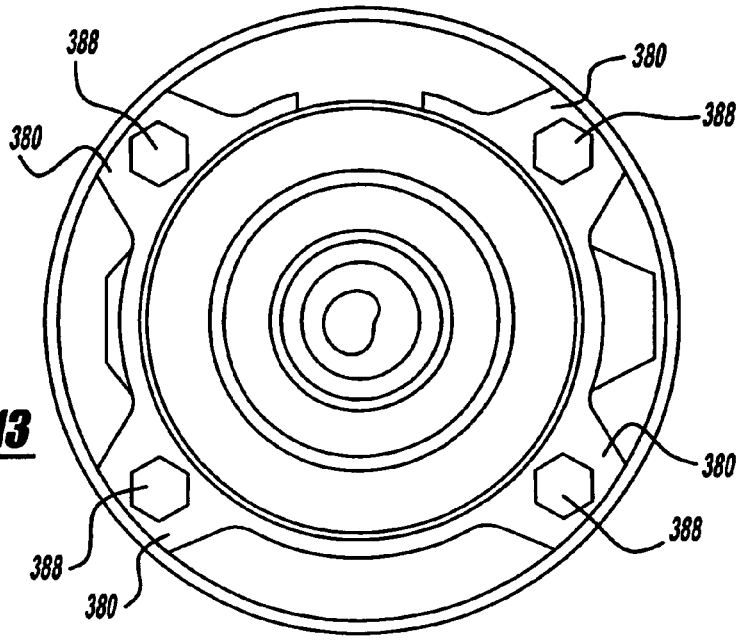
FIG. 13 is a section view of the compressor of FIG. 12, the section being taken along line 13-13 thereof.
Figure 14:
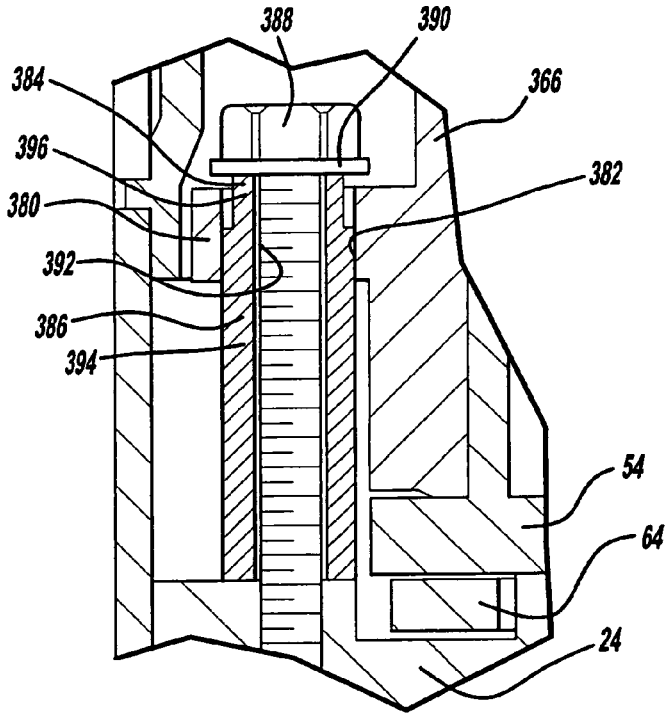
FIG. 14 is an enlarged fragmentary section view of the mounting arrangement shown in FIG. 12.

Referring now to FIGS. 12-14, a scroll compressor which incorporates a non-orbiting scroll mounting arrangement in accordance with another embodiment of the present invention is illustrated and is designated generally by reference numeral 310. Scroll compressor 310 is the same as scroll compressor 10 except that non-orbiting scroll member 66 is replaced by non-orbiting scroll member 366 and the mounting arrangement for non-orbiting scroll member 366.

Non-orbiting scroll member 366 is also provided having wrap 68 positioned in meshing engagement with wrap 56 of orbiting scroll member 54. Non-orbiting scroll member 366 may define a first plane at an end plate surface thereof and a second plane at a tip of wrap 68. Non-orbiting scroll member 366 has centrally disposed discharge passage 70 communicating with upwardly open recess 72 which is in fluid communication with discharge muffler chamber 74 defined by cap 14 and partition 22. Annular recess 76 is also formed in non-orbiting scroll member 366 within which is disposed seal assembly 78. Recesses 72 and 76 and seal assembly 78 cooperate to define axial pressure biasing chambers which receive pressurized fluid being compressed by wraps 56 and 68 so as to exert an axial biasing force on non-orbiting scroll member 366 to thereby urge the tips of respective wraps 56, 68 into sealing engagement with the opposed end plate surfaces. Non-orbiting scroll member 366 is designed to be mounted to bearing housing 24 and to this end has a plurality of radially outwardly projecting flange portions 380 circumferentially spaced around the periphery thereof as shown in FIG. 13.

As best seen with reference to FIG. 14, flange portion 380 of non-orbiting scroll member 366 has an opening 382 provided therein within which is fitted an elongated cylindrical bushing 384, the lower end 386 of which is seated on bearing housing 24. Bushing 384 may form a guide member for non-orbiting scroll member 366. A bolt 388 having a head washer 390 extends through an axially extending bore 392 provided in bushing 384 and into a threaded opening provided in bearing housing 24. As shown, bore 392 of bushing 384 is of a diameter greater than the diameter of bolt 388 so as to accommodate some relative movement therebetween to enable final precise positioning of non-orbiting scroll member 366. Once non-orbiting scroll member 366 and, hence, bushing 384 have been precisely positioned, bolt 388 may be suitably torqued thereby securely and fixedly clamping bushing 384 between bearing housing 24 and washer 390. Washer 390 serves to ensure uniform circumferential loading on bushing 384 as well as to provide a bearing surface for the head of bolt 388 thereby avoiding any potential shifting of bushing 384 during the final torquing of bolt 388. It should be noted that as shown in FIG. 14, the axial length of bushing 384 will be sufficient to allow non-orbiting scroll member 366 to slidably move axially along bushing 384 in a direction away from orbiting scroll member 54, thereby affording an axially compliant mounting arrangement with washer 390 and the head of bolt 388 acting as a positive stop limiting such movement. Substantially identical bushings, bolts and washers are provided for each of the other flange portions 380. The amount of separating movement can be relatively small (e.g., on the order of 0.005" for a scroll 3" to 4" in diameter and 1" to 2" in wrap height) and, hence, the compressor will still operate to compress even though the separating force resulting therefrom may exceed the axial restoring force such as may occur on start-up. Because the final radial and circumferential positioning of the non-orbiting scroll is accommodated by the clearances provided between bolts 388 and the associated bushings 384, the threaded openings in bearing housing 24 need not be as precisely located as would otherwise be required, thus reducing the manufacturing costs associated therewith.

Bushings 384 include a large diameter portion 394 and a small diameter portion 396. The relative diameters of large diameter portion 394 and the diameter of opening 382 will be such as to allow sliding movement therebetween yet effectively resist radial and/or circumferential movement of non-orbiting scroll member 366. Large diameter portion 394 is located at the lower side or bottom of bushing 384 in order to move the centroid of reaction for bushing 384 toward the tip of wrap 68 of non-orbiting scroll member 366. Large diameter portion 394 may be located proximate to the first plane discussed above.

Figure 15:
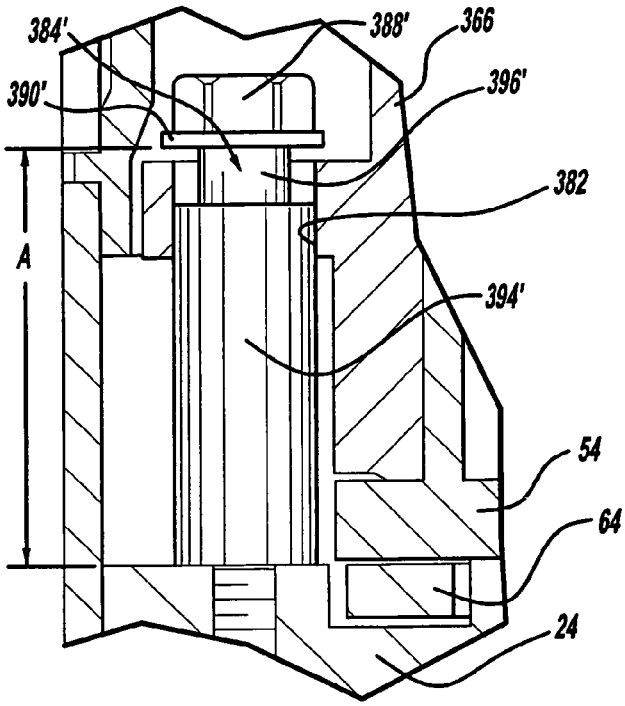
FIGS. 15-22 are views similar to FIG. 14, but showing mounting arrangements in accordance with other embodiments.

Alternatively, as shown in FIG. 15, the bolts 388 and bushings 384 may be replaced by a shoulder bolt 388' having a shoulder portion 384'. Shoulder portion 384' of shoulder bolt 388' includes a large diameter portion 394' and a small diameter portion 396'. In the example of FIG. 15, shoulder bolt 388' may form a guide member for non-orbiting scroll member 366. Large diameter portion 394' is located at the lower side or bottom of shoulder portion 384' in order to move the centroid of reaction for shoulder portion 384' of shoulder bolt 388' toward the tip of wrap 68 of non-orbiting scroll member 366. Large diameter portion 394' of shoulder bolt 388' is slidably fit within openings 382 provided in flange portions 380 of non-orbiting scroll member 366. In this embodiment, the axial length "A" of shoulder portion 384' of shoulder bolt 388' will be selected such that a slight clearance will be provided between an integral washer 390' of the head portion of bolt 388' and the opposed surface of flange portion 380 when non-orbiting scroll member 366 is fully seated against orbiting scroll member 54 to thereby permit a slight axial separation movement in a like manner to that described above with reference to FIG. 14. Also, as noted above, integral washer 390' of bolt 388' will act as a positive stop to limit this axial separating movement of non-orbiting scroll member 366. The relative diameters of large diameter portion 394' and bore 382 will be such as to allow sliding movement therebetween, yet effectively resist radial and/or circumferential movement of non-orbiting scroll member 366. While this embodiment eliminates concern over potential shifting of bushing 384 relative to bolt 388 which could occur in the embodiment of FIG. 14, it is somewhat more costly in that the threaded holes in bearing housing 24 must be precisely located.

Figure 16:
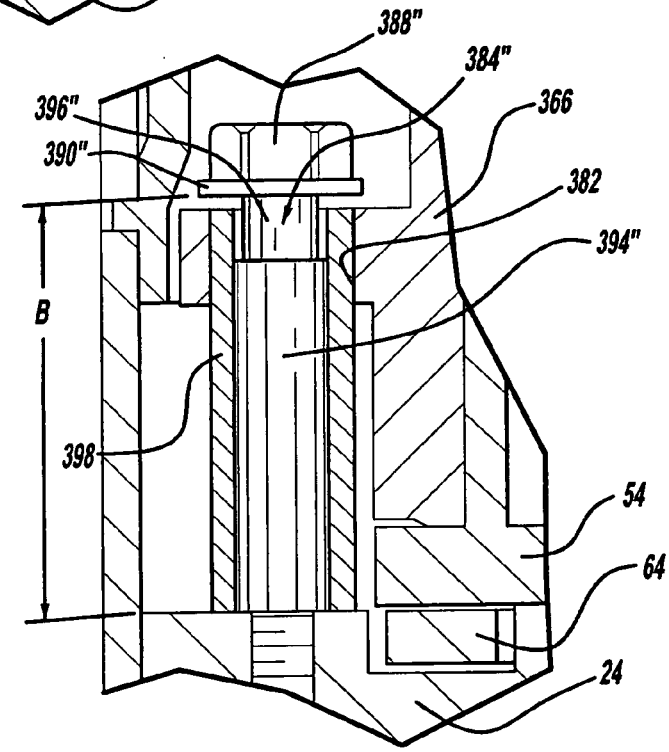

FIG. 16 illustrates another embodiment of the present invention. In FIG. 16, a bushing 398 is pressfitted within each of the openings 382 provided in respective flange portions 380. A stepped shoulder bolt 388" is provided extending through bushing 398 and, as described above for FIG. 15, includes a shoulder portion 384" having an axial length "B" selected with respect to the length of bushing 398 to afford the axial movement of non-orbiting scroll member 366. In the example of FIG. 16, shoulder bolt 388" may form a guide member for non-orbiting scroll member 366. Shoulder portion 384" of shoulder bolt 388" includes a large diameter portion 394" and a small diameter portion 396". Large diameter portion 394" is located at the lower side or bottom of shoulder portion 384" in order to move the centroid of reaction for shoulder portion 384" of shoulder bolt 388" toward the tip of wrap 68 of non-orbiting scroll member 366. In this embodiment, because bushing 398 is pressfitted within opening 382, it will slidably move along large diameter portion 394" of shoulder portion 384" of bolt 388" along with non-orbiting scroll member 366 to afford the desired axially compliant mounting arrangement. Additionally, since bushing 398 is coupled to non-orbiting scroll member 366, large and small diameter portions 394", 396" may define the first and second circumferential portions discussed above. This embodiment allows for somewhat less precise locating of the threaded bores in bearing housing 24 as compared to the embodiment of FIG. 15 in that bushing 398 may be bored and/or reamed to provide the final precise positioning of non-orbiting scroll member 366. Further, because the axial movement occurs between bushing 398 and shoulder bolt 388", concern as to possible wearing of openings 382 provided in non-orbiting scroll member 366 is eliminated because any wear occurs between bushing 398 and shoulder bolt 388". As shown, bushing 398 has an axial length such that it is seated on bearing housing 24 when non-orbiting scroll member 366 is fully seated against orbiting scroll member 54; however, if desired, a shorter bushing 398 could be utilized in place thereof. Again, as in the above-described embodiments, an integral washer 390" of shoulder bolt 388" will cooperate either with the end of bushing 398 or flange 380 as desired to provide a positive stop limiting axial separating movement of non-orbiting scroll member 366.

Figure 17:
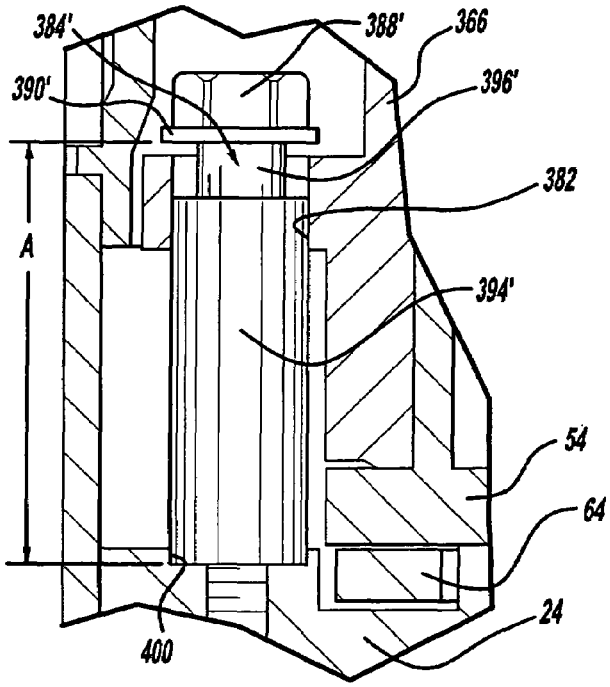

In the embodiment of FIG. 17, a counterbore 400 is provided in bearing housing 24. Counterbore 400 serves to receive large diameter portion 394' of shoulder portion 384' of bolt 388' illustrated in FIG. 15. In the example of FIG. 17, bolt 388' may form a guide member for non-orbiting scroll member 366. Again, the axial length "C" of shoulder portion 384' will be selected so as to allow for the desired limited axial movement of non-orbiting scroll member 366 and integral washer 390' of bolt 388' will provide a positive stop therefor. Because counterbore 400 can be reamed to establish the precise relative location of non-orbiting scroll member 366, the tolerance for locating the threaded bore in bearing housing 24 may be increased somewhat. Further, this embodiment eliminates the need to provide and assemble separately fabricated bushings. Also, similarly to that described above, the relative diameters of large diameter portion 394' of shoulder portion 388' with respect to bore 382 in non-orbiting scroll member 366 will be such to accommodate axial sliding movement yet resist radial and circumferential movement. Similar to FIG. 15, large diameter portion 394' is located at the lower side or bottom of shoulder portion 388' in order to move the centroid of reaction for shoulder portion 384' of shoulder bolt 388' toward the tip of wrap 68 of non-orbiting scroll member 366. Thus, the embodiment of FIG. 17 is similar to the embodiment of FIG. 15 and the description of FIG. 15 applies to FIG. 17.

Figure 18:
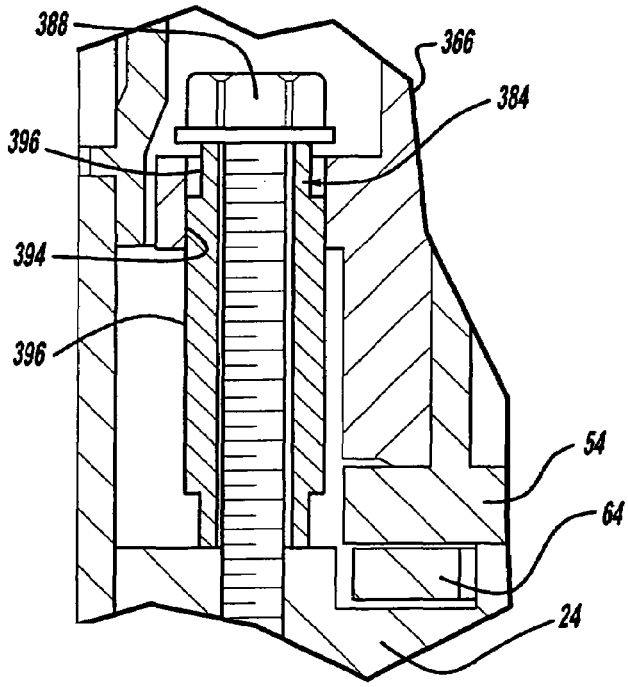

Referring now to FIG. 18, another embodiment of the present invention is illustrated. The embodiment illustrated in FIG. 18 is the same as that described above for FIG. 14 but in FIG. 18, bushing 384 includes two small diameter portions 396 and large diameter portion 394. In the example of FIG. 18, bushing 384 may form a guide member for non-orbiting scroll member 366. By incorporating two large diameter portions 396 at opposite sides of bushing 384, bushing 384 becomes symmetrical, eliminating the need to orient bushing 384 during the assembly process. The description of FIG. 14 above applies to FIG. 18 also with the only difference being the incorporation of the second small diameter portion 396.

Figure 19:
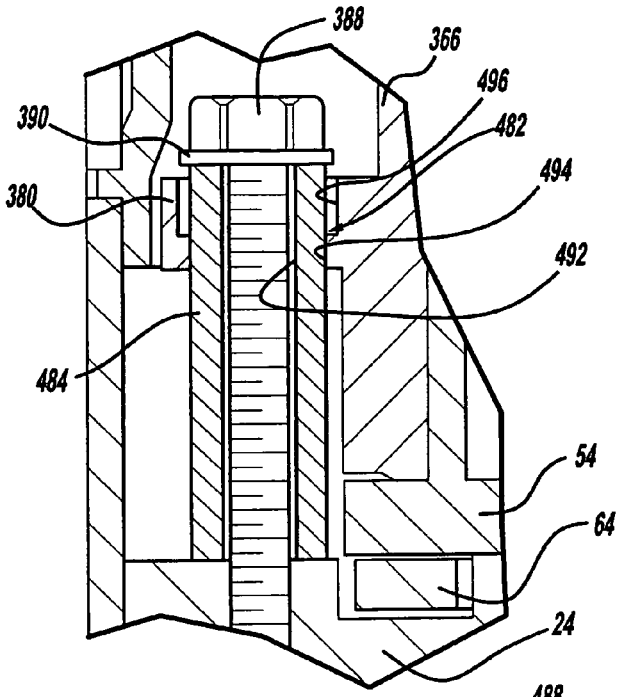

Referring now to FIG. 19, another embodiment of the present invention is illustrated. In the embodiment shown in FIG. 19, flange portion 380 of non-orbiting scroll member 366 has a stepped opening 482 provided therein within which is fitted an elongated cylindrical bushing 484, the lower end of which is seated on bearing housing 24. In the example of FIG. 19, bushing 484 may form a guide member for non-orbiting scroll member 366. A bolt 388 having a head with a washer 390 extends through an axially extending bore 492 provided in bushing 484 and into the threaded opening provided in bearing housing 24. As shown, bore 492 of bushing 484 is of a diameter greater than the diameter of bolt 388 so as to accommodate some relative movement therebetween to enable final precise positioning of non-orbiting scroll member 366. Once non-orbiting scroll member 366, and hence bushing 484, have been precisely positioned, bolt 388 may be suitably torqued, thereby securely and fixedly clamping bushing 484 between bearing housing 24 and washer 390. Washer 390 serves to ensure uniform circumferential loading on bushing 484, as well as to provide a bearing surface for the head of bolt 388, thereby avoiding any potential shifting of bushing 484 during the final torquing of bolt 388. It should be noted that, as shown in FIG. 19, the axial length of bushing 484 will be sufficient to allow non-orbiting scroll member 366 to slidably move axially along bushing 484 in a direction away from the orbiting scroll member 54, thereby affording the axially compliant mounting arrangement with washer 390 and the head of bolt 388 acting as a positive stop limiting such movement. Substantially identical bushings, bolts, washers and holes are provided for each of the other flange portions 380. The amount of separating movement can be relatively small (e.g., on the order of 0.005" for a scroll 3" to 4" in diameter and 1" to 2" in wrap height) and, hence, compressor 10 will still operate to compress even though the separating force resulting therefrom may exceed the axial restoring force such as may occur on start-up. Because the final radial and circumferential positioning of non-orbiting scroll member 366 is provided between bolts 388 and the associated bushings 484, the threaded openings in bearing housing 24 need not be as precisely located as would otherwise be required, thus reducing the manufacturing costs associated therewith.

Stepped opening 482 includes a small diameter portion 494 and a large diameter portion 496, forming first and second circumferential portions thereof. The relative diameters of small diameter portion 494 and the outside diameter of bushing 484 will be such as to allow sliding movement therebetween, yet effectively resist radial and/or circumferential movement of non-orbiting scroll member 366. Small diameter portion 494 is located at the lower side or bottom of flange portion 380 in order to move the centroid of reaction for bushing 484 toward the top of wrap 68 of non-orbiting scroll member 366.

Figure 20:
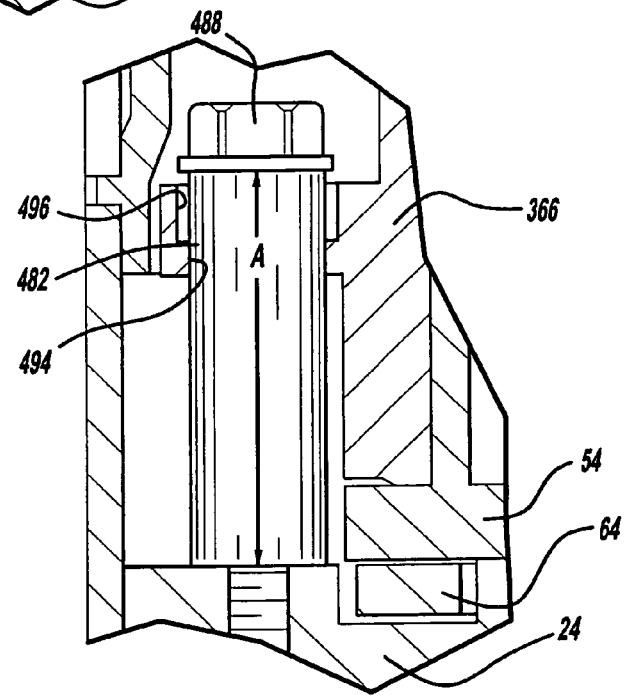

Alternatively, as shown in FIG. 20, bolts 380 and bushings 484 may be replaced by a shoulder bolt 488 slidably fit within stepped openings 482 provided in respective flange portions 380 of non-orbiting scroll member 366. In the example of FIG. 20, shoulder bolt 488 may form a guide member for non-orbiting scroll member 366. Stepped openings 482 includes small diameter portion 494 and large diameter portion 496. Small diameter portion 494 is located at the lower side or bottom of opening 482 in order to move the centroid of reaction for the shoulder portion of shoulder bolt 488 toward the tip of wrap 68 of non-orbiting scroll member 366. In this embodiment, the axial length "A" of the shoulder portion of shoulder bolt 488 will be selected such that a slight clearance will be provided between the head portion of bolt 488 and the opposed surface of flange portion 380 when non-orbiting scroll member 366 is fully axially seated against orbiting scroll member 54 to thereby permit a slight axial separating movement in like manner as described above with reference to FIG. 14. Also, as noted above, the head of bolt 488 will act as a positive stop to limit this axial separating movement of non-orbiting scroll member 366. The relative diameters of small diameter portion 494 of bore 482 and the outer diameter of the shoulder portion of bolt 488 will be such as to allow sliding movement therebetween, yet resist radial and/or circumferential movement of non-orbiting scroll member 366. While this embodiment eliminates concern over potential shifting of the bushing relative to the securing bolt, which could occur in the embodiment of FIG. 19, it is somewhat more costly in that the threaded holes in bearing housing 24 must be precisely located.

Figure 21:
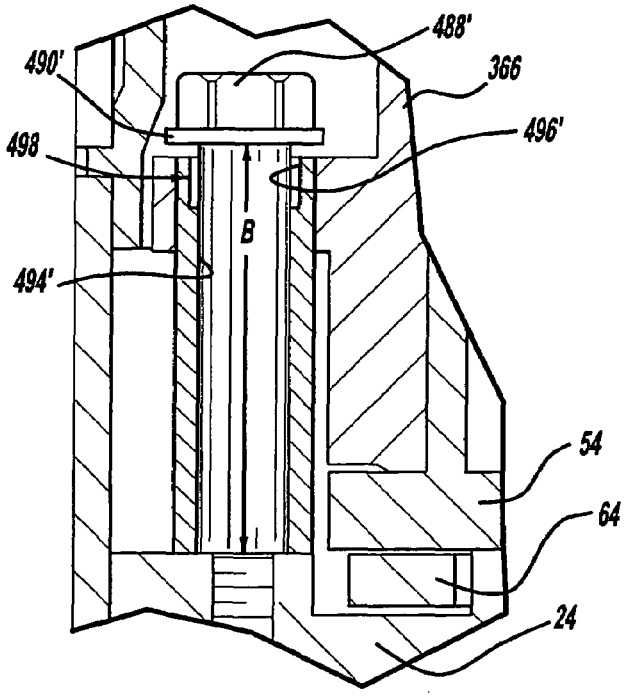

FIG. 21 illustrates another embodiment of the present invention. In FIG. 21, a bushing 498 is pressfitted within each opening 382 provided in respective flange portions 380. A shoulder bolt 488' is provided extending through bushing 498 and, as described above, includes a shoulder portion having an axial length "B" selected with respect to the length of bushing 498 to afford the desired axial movement of non-orbiting scroll member 366. In the example of FIG. 21, shoulder bolt 488' may form a guide member for non-orbiting scroll member 366. Bushing 498 includes a small diameter portion 494' and a large diameter portion 496'. Small diameter portion 494' is located at the lower side or bottom of opening 382 in order to move the centroid of reaction for the shoulder portion of bolt 488' toward the tip of wrap 68 of non-orbiting scroll member 366. In this embodiment, because bushing 498 is pressfitted within opening 382, it will slidingly move along the shoulder portion of bolt 488' along with non-orbiting scroll member 366 to afford the desired axially compliant mounting arrangement. Additionally, since bushing 498 is coupled to non-orbiting scroll member 366, small and large diameter portions 494', 496' may define first and second circumferential portions of flanged portion 380. This embodiment allows for somewhat less precise locating of the threaded bores in bearing housing 24 as compared to the embodiment of FIG. 20 in that bushing 498 may be bored and/or reamed to provide the final precise positioning of non-orbiting scroll member 366. Further, because the axial movement occurs between bushing 498 and shoulder bolt 488', concerns as to possible wearing of openings 382 provided in non-orbiting scroll member 366 is eliminated because any wear occurs between bushing 498 and shoulder bolt 488'. As shown, bushing 498 has an axial length such that it is seated on bearing housing 24 when non-orbiting scroll member 366 is fully seated against orbiting scroll member 54, however, if desired, a shorter bushing 498 could be utilized in place thereof. Again, as in the above-described embodiments, an integral washer 490' of shoulder bolt 488' will cooperate either with the end of bushing 498 or flange 380 as desired to provide a positive stop limiting axial separating movement of non-orbiting scroll member 366.

Figure 22:
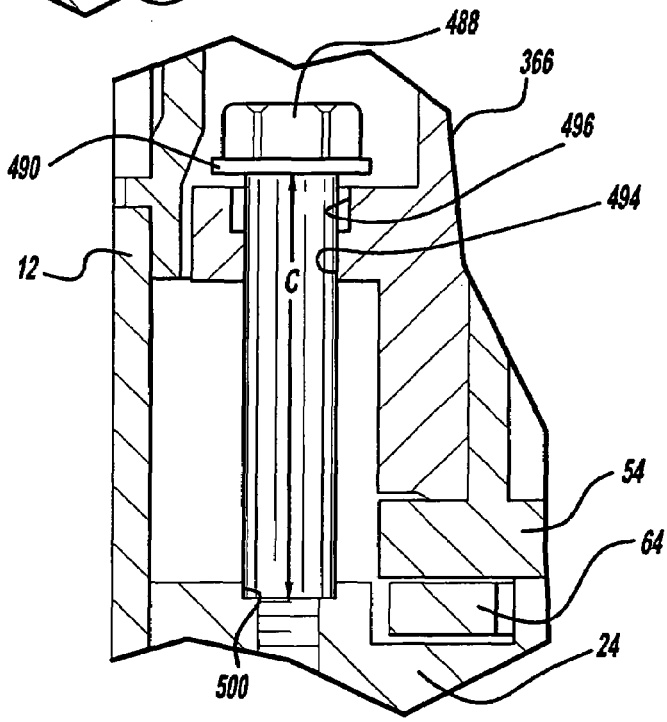

In the embodiment of FIG. 22, a counterbore 500 is provided in bearing housing 24. Counterbore 500 serves to receive the shoulder portion of bolt 488. In the example of FIG. 22, bolt 488 may form a guide member for non-orbiting scroll member 366. Again, the axial length "C" of the shoulder portion of bolt 488 will be selected so as to allow for the desired limited axial movement of non-orbiting scroll member 366 and integral washer 490 of bolt 488 will provide a positive stop therefore. Because counterbore 500 can be reamed to establish the precise relative location of non-orbiting scroll member 366, the tolerance for locating the threaded bore of bearing housing 24 may be increased somewhat. Further, this embodiment eliminates the need to provide and assemble separately fabricated bushings. Also similarly to that described above, the relative diameters of the shoulder portion of bolt 480 with respect to small diameter portion 494 of bore 482 in non-orbiting scroll member 366 will be such to accommodate axial sliding movement, yet resist radial and circumferential movement. Similar to FIG. 20, small diameter portion 494 is located at the lower side or bottom of bore 482 in order to move the centroid of reaction for shoulder bolt 488 toward the tip of wrap 68 of non-orbiting scroll member 366. Thus, the embodiment of FIG. 22 is similar to the embodiment of FIG. 20, and the description of FIG. 20 applies to FIG. 22.

Figure 23:
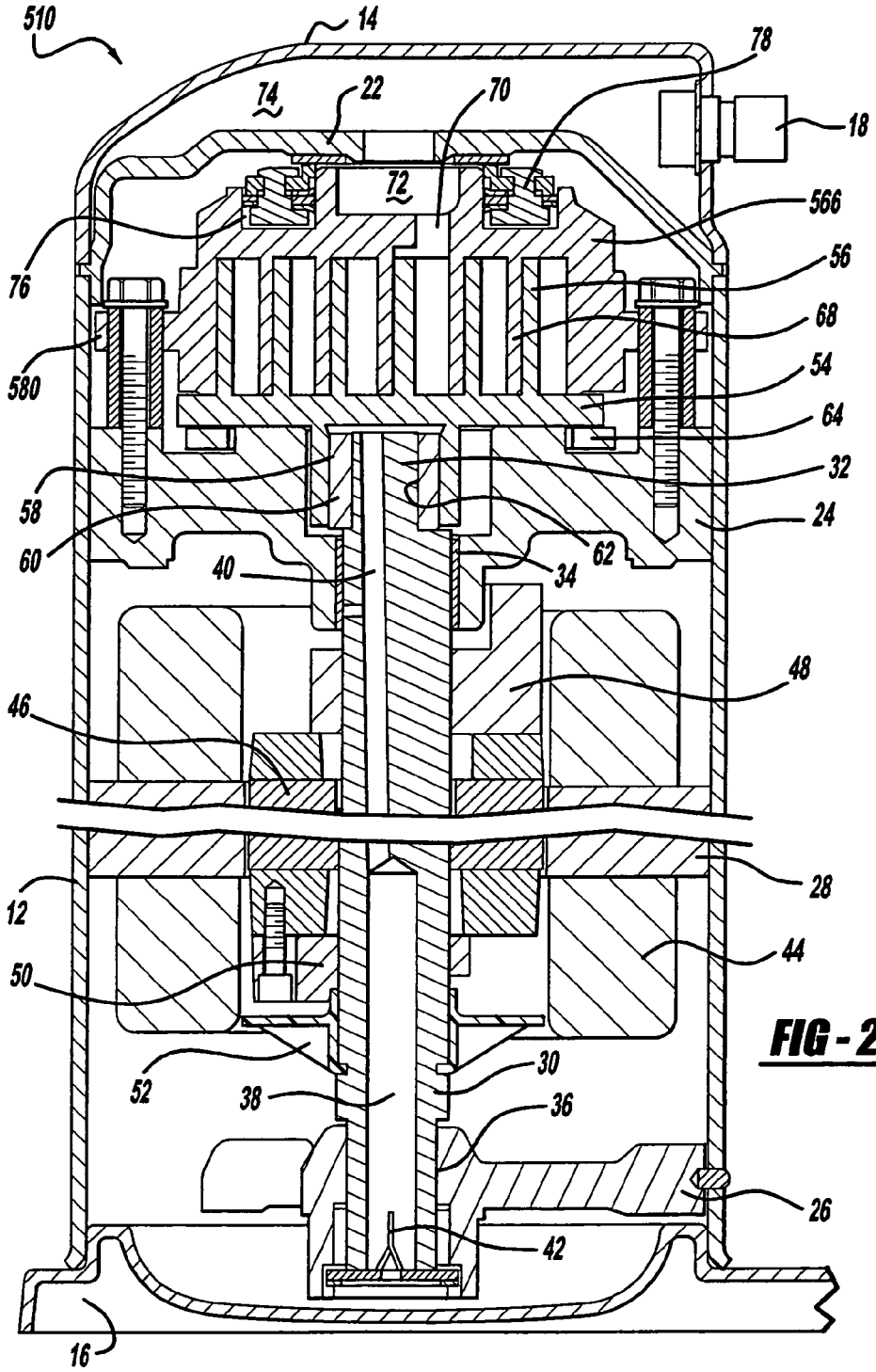
FIG. 23 is a vertical cross-section view of a scroll compressor incorporating a non-orbiting scroll mounting arrangement in accordance with another embodiment.

Referring now to FIG. 23, a scroll compressor which incorporates a non-orbiting scroll mounting arrangement in accordance with another embodiment of the present invention is illustrated and is designated generally by reference numeral 510. Scroll compressor 510 is the same as scroll compressor 10 except that non-orbiting scroll member 66 is replaced by non-orbiting scroll member 66 is replaced by non-orbiting scroll member 566 and the mounting arrangement for non-orbiting scroll member 566.

Non-orbiting scroll member 566 is also provided having wrap 68 positioned in meshing engagement with wrap 56 of orbiting scroll member 54. Non-orbiting scroll member 566 may define a first plane at an end plate surface thereof and a second plane at a tin of wrap 68. Non-orbiting scroll member 566 has centrally disposed discharge passage 70 communicating with upward open recess 72 which is in fluid communication with discharge muffler chamber 74 defined by cap 14 and partition 22. Annular recess 76 is also formed in non-orbiting scroll member 566 within which is disposed seal assembly 78. Recess 72 and 76 and seal assembly 78 cooperate to define axial pressure biasing chambers which receive pressurized fluid being compressed by wraps 56 and 68 so as to exert to axial biasing force on non-orbiting scroll member 566 to thereby urge the tips of respective wraps 56, 68 into sealing engagement with the opposed end plate surfaces. Non-orbiting scroll member 566 is designed to be mounted to bearing housing 24 and to this end has a plurality of radially outwardly projecting flange portions 580 circumferentially spaced around the periphery thereof in the same manner as flange portions 380 illustrated in FIG. 13.

The axial centerline for outwardly projecting flange portions 580 is positioned at the centroid of reaction for flange portions 580 and thus there is no need to provide a stepped bushing to move the centroid of reaction. Flange portions 580 may be located axially between the first and second planes discussed above. Each flange portion 580 is provided with a circular cylindrical bushing 584 disposed within a bore 585 extending through flange 580.

The function, operation and advantages of compressor 510 are the same as those detailed above for compressor 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll compressor comprising:

a shell;

a compression mechanism contained within said shell and including a non-orbiting scroll supported for axial displacement relative said shell, said non-orbiting scroll including an end plate having a wrap extending therefrom and a flange having a bore extending therethrough; and a guide member axially fixed relative said shell and extending through said bore in said flange, a first portion of said guide member including a first perimeter and being disposed within and generally abutting a first circumferential portion of said bore and a second portion of said guide member including a second perimeter less than the first perimeter and being disposed within and generally spaced apart from a second circumferential portion of said bore.

2. The scroll compressor of claim 1, wherein said bore extends axially through said flange.

3. The scroll compressor of claim 1, further comprising a motor contained within said shell and drivingly coupled to said compression mechanism.

4. The scroll compressor of claim 1, wherein an annular recess is located between said second portion of said guide member and said second circumferential portion of said bore.

5. The scroll compressor of claim 4, wherein said annular recess surrounds an entire perimeter of said guide member second portion.

6. The scroll compressor of claim 1, wherein said flange includes a bushing defining said bore.

7. The scroll compressor of claim 1, wherein said guide member includes an axially extending member and a bushing extending around a circumference of said axially extending member.

8. The scroll compressor of claim 1, wherein said wrap includes an axial height generally defined between a tip portion and said end plate, said end plate defining a first plane, a second plane disposed proximate said tip portion and generally parallel to said first plane, said first and second planes generally separated by said axial height, said guide member first portion generally abutting said first circumferential portion at a location proximate said second plane.

9. The scroll compressor of claim 1, wherein said wrap includes an axial height generally defined between a tip portion and said end plate, said end plate defining a first plane, a second plane disposed proximate said tip portion and generally parallel to said first plane, said first and second planes generally separated by said axial height, said guide member first portion generally abutting said first circumferential portion at a location proximate said first plane.

10. The scroll compressor of claim 1, wherein said wrap includes an axial height generally defined between a tip portion and said end plate, said end plate defining a first plane, a second plane disposed proximate said tip portion and generally parallel to said first plane, said first and second planes generally separated by said axial height, said guide member first portion generally abutting said first circumferential portion at a location between said first and second planes.

11. The scroll compressor of claim 1, wherein said guide member includes a bolt.

12. The scroll compressor of claim 1, wherein said guide member first portion includes a maximum width portion having a first width and said guide member second portion includes a maximum width portion having a second width generally less than said first width.

13. The scroll compressor of claim 12, wherein said first and second widths define first and second diameters.

14. The scroll compressor of claim 1, further comprising a main bearing housing contained within and coupled to said shell, said non-orbiting scroll axially displaceably mounted to said main bearing housing.

15. The scroll compressor of claim 1, further comprising a main bearing housing contained within and coupled to said shell, said guide member axially fixed to said main bearing housing.

16. A scroll compressor comprising:

a shell;

a compression mechanism contained within said shell and including a non-orbiting scroll supported for axial displacement relative said shell, said non-orbiting scroll including an end plate having a wrap extending therefrom and a flange having a bore extending therethrough; and a guide member axially fixed relative said shell and extending through said bore in said flange, a first portion of said guide member disposed within a circumferential portion of said bore and including a first maximum width portion having a first width and generally abutting said circumferential portion of said bore, a second portion of said guide member disposed within said circumferential portion of said bore and including a second maximum width portion having a second width generally less than said first width.

17. The scroll compressor of claim 16, wherein said first and second widths define first and second diameters.

18. The scroll compressor of claim 16, wherein said circumferential portion of said bore defines a width generally equal to said first width.

19. The scroll compressor of claim 16, wherein said circumferential portion of said bore defines a width generally greater than said second width.

20. The scroll compressor of claim 16, wherein said second portion of said guide member and said circumferential portion of said bore define an annular recess therebetween.

21. The scroll compressor of claim 16, wherein said guide member includes an axially extending member and a bushing extending around a circumference of said axially extending member.

22. A scroll compressor comprising:

a shell;

a compression mechanism contained within said shell and including a non-orbiting scroll supported for axial displacement relative said shell, said non-orbiting scroll including an end plate having a wrap extending therefrom and a flange having a bore extending therethrough; and a guide member axially fixed relative said shell and extending through said bore in said flange, a first portion of said guide member disposed within said bore, said bore including first and second circumferential portions spaced axially apart from one another, said first circumferential portion of said bore generally abutting said guide member first portion at a first minimum width portion having a first width, said second circumferential portion of said bore including a second minimum width portion having a second width generally greater than said first width, said second circumferential portion spaced radially apart from said guide member first portion defining a recess therebetween.

23. The scroll compressor of claim 22, wherein said first and second widths define first and second diameters.

24. The scroll compressor of claim 22, wherein said guide member first portion includes a width generally equal to said first width.

25. The scroll compressor of claim 22, wherein said guide member first portion includes a width generally less than said second width.

26. The scroll compressor of claim 22, wherein said recess surrounds a perimeter of said guide member first portion and is generally defined by said guide member first portion and a said second circumferential portion.

27. The scroll compressor of claim 22, wherein said flange includes a bushing defining said bore.

* * * * *